US006289875B1

(12) United States Patent
Shinohara et al.

(10) Patent No.: US 6,289,875 B1
(45) Date of Patent: Sep. 18, 2001

(54) FUEL INJECTION PUMP

(75) Inventors: Yukihiro Shinohara, Kariya; Hiroyuki Nishimura, Obu; Toshikazu Watanabe, Nagoya; Akihiro Kuroda, Anjo; Katsunori Furuta, Kariya, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/468,810

(22) Filed: Dec. 22, 1999

(30) Foreign Application Priority Data

Dec. 25, 1998 (JP) ..... 10-369731
Nov. 5, 1999 (JP) ..... 11-315266

(51) Int. Cl.[7] ..... F02M 41/00
(52) U.S. Cl. ..... 123/450; 123/495; 417/273
(58) Field of Search ..... 123/450, 495, 123/500, 504; 417/273, 462

(56) References Cited

U.S. PATENT DOCUMENTS 4,712,528 * 12/1987 Schaffitz ..... 123/446
5,167,493 * 12/1992 Kobari ..... 417/273
5,383,770 * 1/1995 Hisahara ..... 417/273
5,688,110 * 11/1997 Djordjevic ..... 417/254
5,701,873 12/1997 Schneider ..... 123/516

* cited by examiner

*Primary Examiner*—Henry C. Yuen
*Assistant Examiner*—Mahmoud Gimie
(74) *Attorney, Agent, or Firm*—Nixon & Vanderhye PC

(57) ABSTRACT

In order to prevent a damage on a component forming a pressure feed fuel passage and to reduce a fuel injection pump in size and weight, the pressure feed fuel passage having fuel discharge passage, fuel chamber and accommodation hole formed in respective cylinder heads is formed straightly in respective cylinder heads, and has communication port for communicating with fuel pressure chamber and fuel outlet which has an opening at an outer peripheral wall of the cylinder heads. Fuel pressurized in fuel pressure chamber at the cylinder head side is introduced into fuel chamber of cylinder head via fuel passage and fuel lines. Fuel pressurized in both fuel pressure chambers is merged at fuel chamber of cylinder head, and is supplied to a common-rail via fuel passage.

18 Claims, 12 Drawing Sheets

FUEL INJECTION PUMP

CROSS REFERENCE TO RELATED APPLICATIONS

This application is based upon and claims priority from Japanese patent application Nos. Hei 10-369731, filed Dec. 25, 1998, and Hei 11-315266, filed Nov. 5, 1999, the entire contents of which are incorporated herein by reference.

BACKGROUND OF THE INVENTION

1. Field of the Invention

The present invention relates to a fuel injection pump for an internal combustion engine (hereinafter referred to as "the engine").

2. Description of Related Art

One type of known radial pump has plural plungers radially provided at an outer periphery of a cam, and pressurizes fuel sucked into fuel pressurizing chambers formed on respective plungers. According to the radial pump, in general, pressure feed fuel passages for transferring high pressure fuel pressurized in the fuel pressurizing chambers are united together in a pump housing, and the fuel is supplied to a common-rail from the united pressure feed fuel passage.

However, when the plural pressure feed fuel passages are united in the pump housing to form one pressure feed fuel passage, the pump housing gets a corner portion at the united portion of the pressure feed fuel passage. Since a fuel injection pump for a common-rail-type diesel engine may pressurize fuel up to about 200 MPa, stress caused by fuel pressure concentrates on the corner portion of the pump housing to cause a damage on the corner portion if the corner portion is formed on an inner peripheral wall of the pump housing which forms the pressure feed fuel passage ("the inner peripheral wall of the pump housing which forms the pressure feed fuel passage" is called "passage inner peripheral wall" hereinafter).

Further, when the housing is drilled to form the pressure feed fuel passage, a corner portion is formed on the passage inner peripheral wall after drilling. If the stress caused by the fuel pressure concentrates on the corner portion, the passage inner peripheral wall other than the united portion may be damaged.

In order to prevent the stress concentration on the corner portion of the passage inner peripheral wall caused by the fuel pressure, a thin electrode may be inserted in the pressure feed fuel passage to discharge between the corner portion of the passage inner peripheral wall and the electrode thereby rounding the corner portion, or the corner portion may be polished to remove the corner portion by introducing a fluid including an abrasive material. However, the removal of the corner portion is difficult because the passage length becomes longer when the pressure feed fuel passages are directly united together in the pump housing.

Furthermore, reducing the size of the fuel injection pump has been requested according to the request for reducing engine in size to improve the fuel economy. However, it is difficult to reduce the fuel injection pump in size when the pressure feed fuel passages are united in the pump housing because the pump housing becomes bigger. Further, the weight of the fuel injection pump increases since a hard metal, such as iron, is used for the pressure feed fuel passage. Furthermore, an installation location of a large fuel injection pump is restricted by interference with an engine and engine peripheral components.

SUMMARY OF THE INVENTION

The present invention is made in light of the abovementioned problems, and it is an object of the present invention to provide a fuel injection pump which prevents a damage of a pressure feed fuel passage and which reduces the fuel injection pump in size and weight.

It is another object of the present invention to provide a fuel injection pump which facilitates an assembling operation to a cylinder head and which reduces the number of components and which reduces the manufacturing cost.

According to one aspect of a fuel injection pump of the present invention, the pressure feed fuel passages for feeding fuel from respective pressure chambers are formed in the housing without directly communicating each other in the housing. Accordingly, the length of each of the pressure feed fuel passages is shortened.

Furthermore, since each length of the pressure feed fuel passages is shortened, the fuel injection pump is reduced in size, and the installation degree of freedom for the fuel injection pump is improved.

According to another aspect of the present invention, the pressure feed fuel passage includes a check valve for allowing a fuel flow from a communication port toward a fuel outlet and for inhibiting a reversed fuel flow from the fuel outlet toward the communication port. Further, the cylinder head includes a fuel passage having a fuel opening provided at an outer peripheral wall of the cylinder head at a position different from the fuel outlet. Accordingly, when one of the fuel outlet and the fuel opening of a cylinder head is connected to one of the fuel outlet and the fuel opening of another cylinder head for transmitting fuel from the cylinder head to the other cylinder head and for feeding fuel with pressure unitarily from the other cylinder head, the reversed fuel flow from the pressure feed fuel passage to the fuel pressure chamber is prevented in the other cylinder.

Furthermore, fuel may be individually fed with pressure from respective cylinder heads, or fuel may be unitarily fed with pressure from one cylinder head by connecting each one of the fuel outlet and the fuel opening of a pair of cylinder heads, according to the installation space or installing position of the fuel injection pump. Accordingly, an interference between surrounding components and the fuel line is prevented by changing the combination of the fuel line connections, and the installation degree of freedom for the fuel injection pump is improved.

According to another aspect of the present invention, a pressure limiter is used as a sealing plug for closing the fuel outlet or the fuel opening. Accordingly, the pressure of fuel sent form the fuel injection pump is maintained lower than a predetermined pressure, and the number of components is reduced.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Several embodiments showing the present invention will now be described based on respective drawings.

(First Embodiment)

Figure 1:
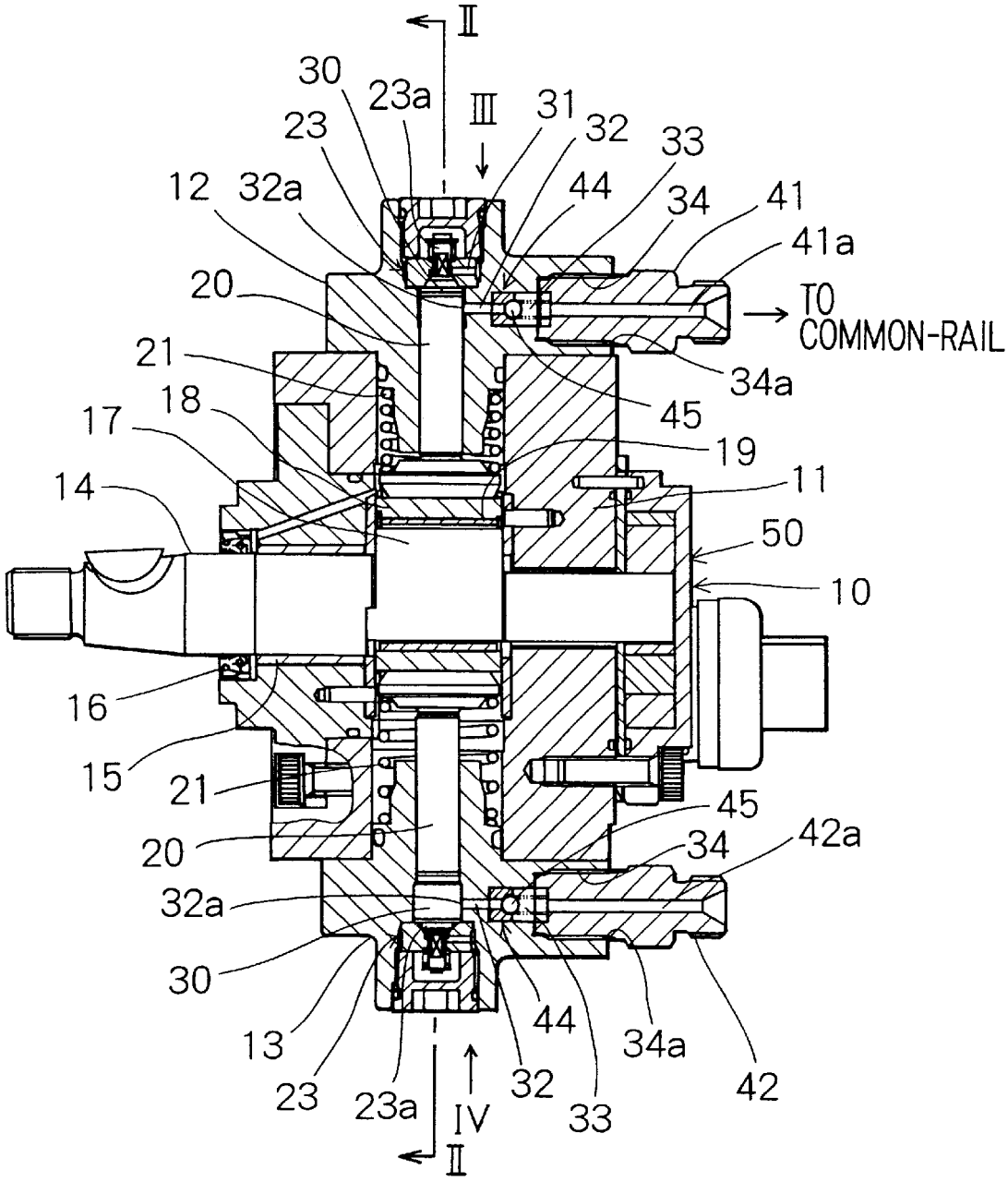
FIG. 1 is a sectional view of a fuel injection pump according to a first embodiment of the present invention.
Figure 2:
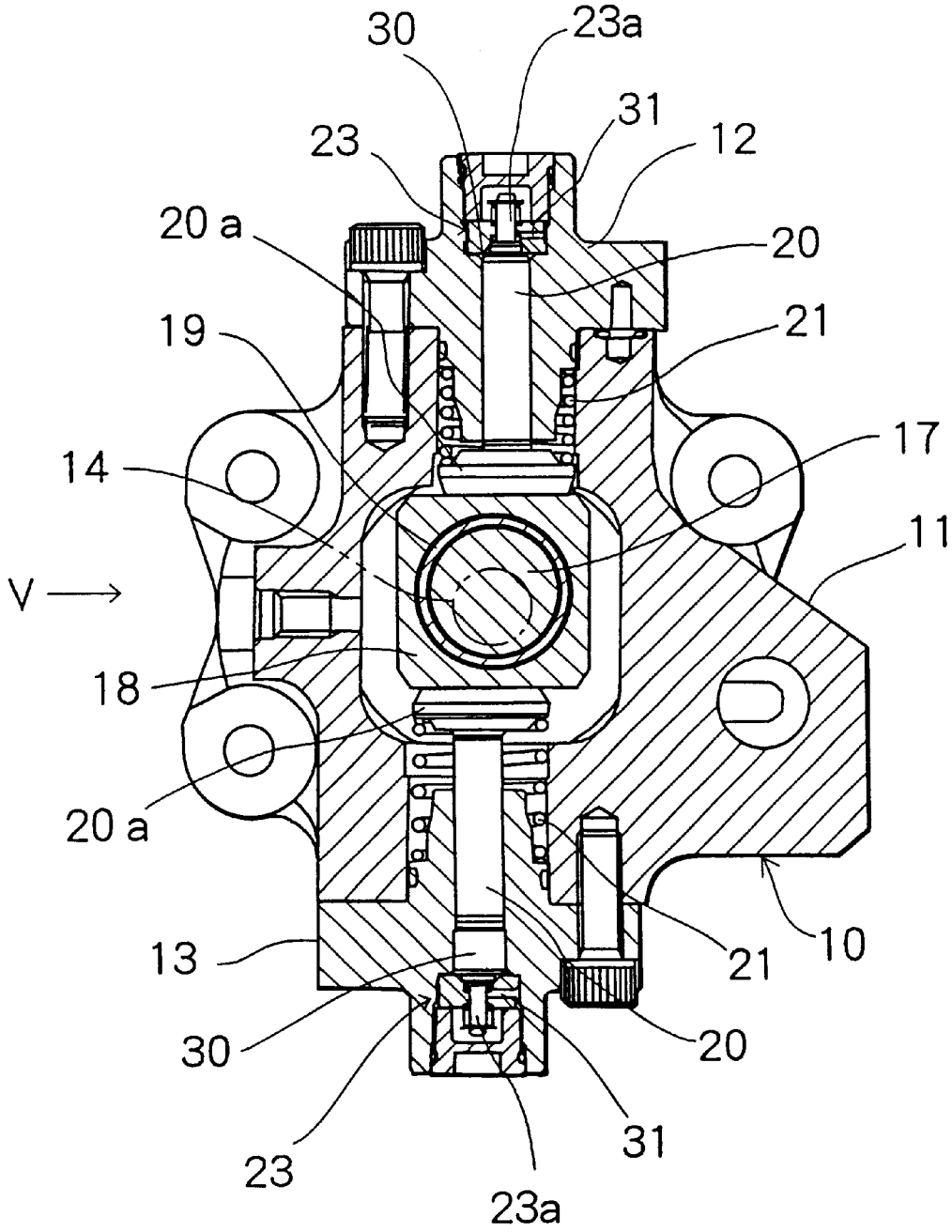
FIG. 2 is a sectional view taken along the line II—II in FIG. 1 according to the first embodiment of the present invention.

A fuel injection pump for a diesel engine according to a first embodiment of the present invention is shown in FIGS. 1 and 2.

As shown in FIG. 1, a pump housing of a fuel injection pump 10 includes a main housing 11 and cylinder heads 12 and 13. The main housing 11 is made of aluminum. The cylinder heads 12 and 13 are made of iron, and support a plunger 20 as a moving member such that the plunger 20 reciprocates. A fuel pressure chamber 30 is formed by an inner peripheral surface of the cylinder heads 12 and 13, an end face of a check valve 23, and an end face of the plunger 20. In the first embodiment, although the cylinder heads 12 and 13 have substantially the same figure, tapped holes, fuel passages and the like are formed in different locations. However, it is possible to form the cylinder heads 12 and 13 identically and to form the tapped holes, fuel passages and the like at the same locations.

As shown in FIG. 1, a drive shaft 14 is rotatably supported by the main housing llviaa journal 15. An oil seal 16 seals between the main housing 11 and the drive shaft 14. As shown in FIG. 2, a cam 17 having a circular cross section is unitarily and eccentrically formed with the drive shaft 14. The plunger 20 is disposed 180° opposite with respect to the drive shaft 14. An outer shape of a shoe 18 is square. A bush 19 is provided slidably with the cam 17 and the shoe 18 between the cam 17 and the shoe 18. An outer peripheral surface of the shoe 18 confronting the plunger 20 and an end face of a plunger head 20*a* are formed in a plane shape to contact with each other.

The plunger 20 is reciprocated by the cam 17 via the shoe 18 the drive shaft 14 rotates, and pressurizes the fuel introduced in the fuel pressure chamber 30 from a fuel inlet passage 31 via the check valve 23. The check valve 23 has a valve member 23*a*, and prevents fuel from being reversed to the fuel inlet passage 31 from the fuel pressure chamber 30.

A spring 21 applies spring force to the plunger 20 toward the shoe 18. Since respective contacting surfaces of the shoe 18 and the plunger 20 are formed in the plane shape, the surface pressure between the shoe 18 and the plunger 20 is reduced. Furthermore, the shoe 18 slides with the cam 17 and revolves without rotation as the cam 17 rotates.

Figure 3:
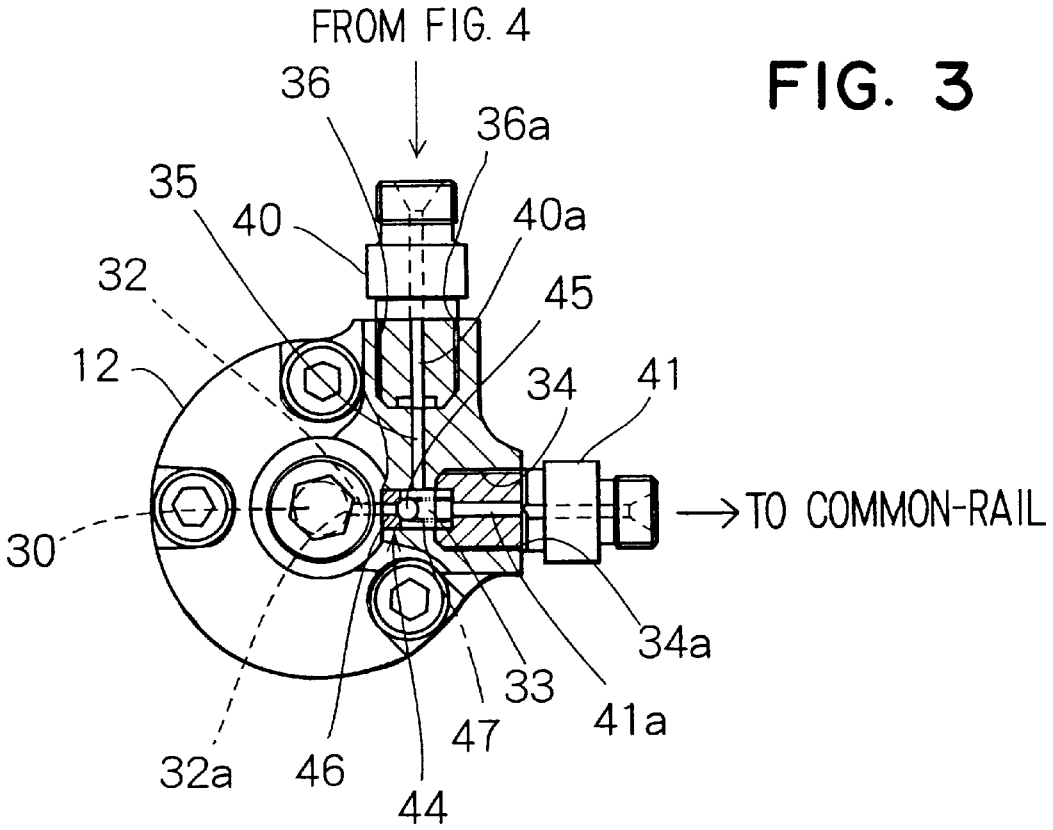
FIG. 3 is a top plan view of the fuel injection pump viewed from the arrow III in FIG. 1 according to the first embodiment of the present invention.
Figure 4:
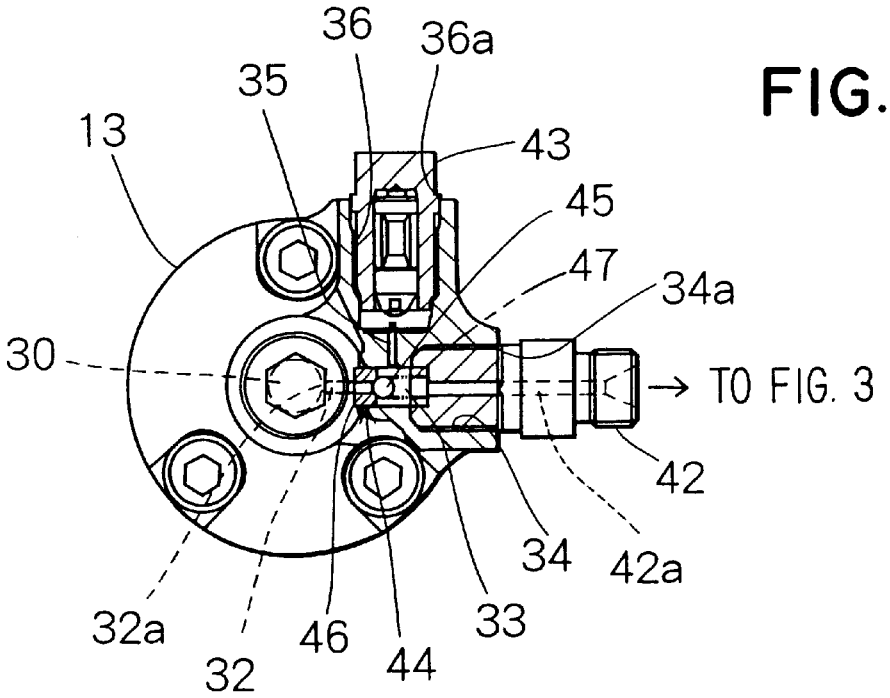
FIG. 4 is a bottom plan view of the fuel injection pump viewed from the arrow IV in FIG. 1 according to the first embodiment of the present invention.

As shown in FIGS. 3 and 4, a fuel discharge passage 32 is linearly formed on respective cylinder heads 12 and 13, and has a communication port 32*a* for the communication with the fuel pressure chamber 30. An elongated hole-shaped fuel chamber 33 having a passage cross section greater than that of the fuel discharge passage 32 is formed at the downstream side of the fuel discharge passage 32 formed on the cylinder head 12. The check valve 44 is housed in the fuel chamber 33. An accommodation hole 34 having a passage cross section greater than that of the fuel chamber 33 is formed on the fuel chamber 33 at the fuel downstream side.

The accommodation hole 34 has an opening on an outer peripheral wall of the cylinder head 12 to form a fuel outlet 34*a*. The fuel discharge passage 32, the fuel chamber 33 and the accommodation hole 34 form a pressure feed fuel passage. A connecting member 41 for connecting fuel lines is housed in the accommodation hole 34 by screwing or the like. A fuel passage 41*a* is formed in the connecting member 41. The fuel passage 41*a* communicates with the fuel chamber 33. The fuel passage 41*a* is formed with an approximately linear arrangement with the fuel discharge passage 32.

A communication passage 35 is formed in the cylinder head 12 in a direction perpendicular to the pressure feed fuel passage. The communication passage 35 communicates with the fuel chamber 33 at the fuel downstream side of the check valve 44. An accommodation hole 36 having a passage cross section greater than that of the communication passage 35 is formed on the communication passage 35 at the opposite side to the fuel chamber 33. The accommodation hole 36 has an opening on an outer peripheral wall of the cylinder head 12 to form a fuel opening 36*a*. The communication passage 35 and the accommodation hole 36 corresponds to the fuel passage in the appended claims.

Accordingly, the pressure feed fuel passage and the fuel passage formed in the cylinder head 12 are communicated with each other at the fuel downstream side of the check valve 44, and have respective openings with perpendicular relationship on the outer peripheral wall of the cylinder head 12. A connecting member 40 for connecting fuel lines is housed in the accommodation hole 36 by screwing or the like. A fuel passage 40*a*, which communicates with the communication passage 35, is formed in the connecting member 40. The fuel passage 40*a* is formed along the direction perpendicular to the pressure feed fuel passage.

The cylinder head 13 is provided at a lower portion of the main housing 11 in FIG. 1. As shown in FIG. 4, a connecting member 42 for connecting fuel lines is housed in the accommodation hole 34 by screwing or the like. A fuel passage 42*a*, which communicates with the fuel chamber 33, is formed in the connecting member 42. The fuel passage 42*a* is formed with an approximately linear arrangement with the fuel discharge passage 32.

A pressure limiter 43 is housed in the accommodation hole 36 by screwing or the like. A fuel line, not shown, is connected to the pressure limiter 43 to return fuel to the low pressure side when fuel pressure exceeds a predetermined pressure. The pressure limiter 43 closes the communication passage 35 within the predetermined pressure range. Accordingly, it is not necessary to provide a sealing plug for closing the communication passage 35 compared to the case that the pressure limiter 43 is provided at a different position.

Figure 5:
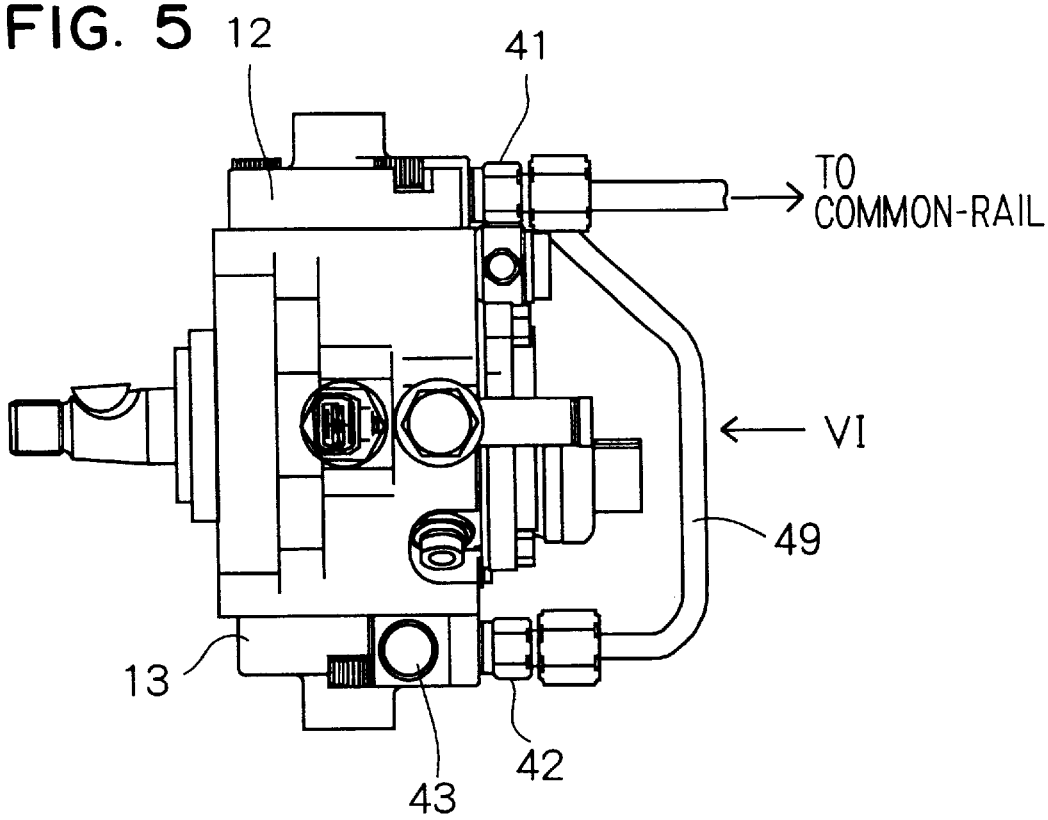
FIG. 5 is a front view viewed from the arrow V in FIG. 2 according to the first embodiment of the present invention.
Figure 6:
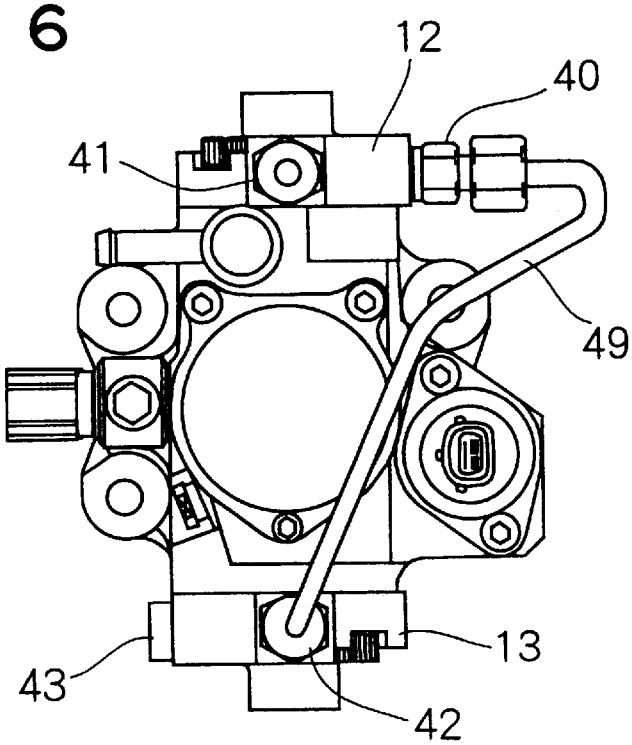
FIG. 6 is a front view viewed from the arrow VI in FIG. 5 according to the first embodiment of the present invention.

The check valve 44 provided at the fuel downstream side of the fuel discharge passage 32 of the cylinder heads 12, 13 includes a ball-shaped valve member 45, a valve seat 46 on which the valve member 45 is seatable, and a spring 47 for impelling the valve member 45 to the valve seat 46. The check valve 44 prevents the reverse flow of the fuel from the communication passage 35 and the fuel chamber 33 locating at the fuel downstream side of the check valve 44 to the fuel pressure chamber 30 via the fuel discharge passage 32. As shown in FIGS. 5 and 6, the connecting member 40 and the connecting member 42 are connected by a fuel line 49 as a pipe. The connecting member 41 is connected to a common-rail not shown as a pressure accumulator via a fuel line. Fuel pressurized by the fuel injection pump 10 is supplied to the common-rail from the connecting member 41.

Figure 7:
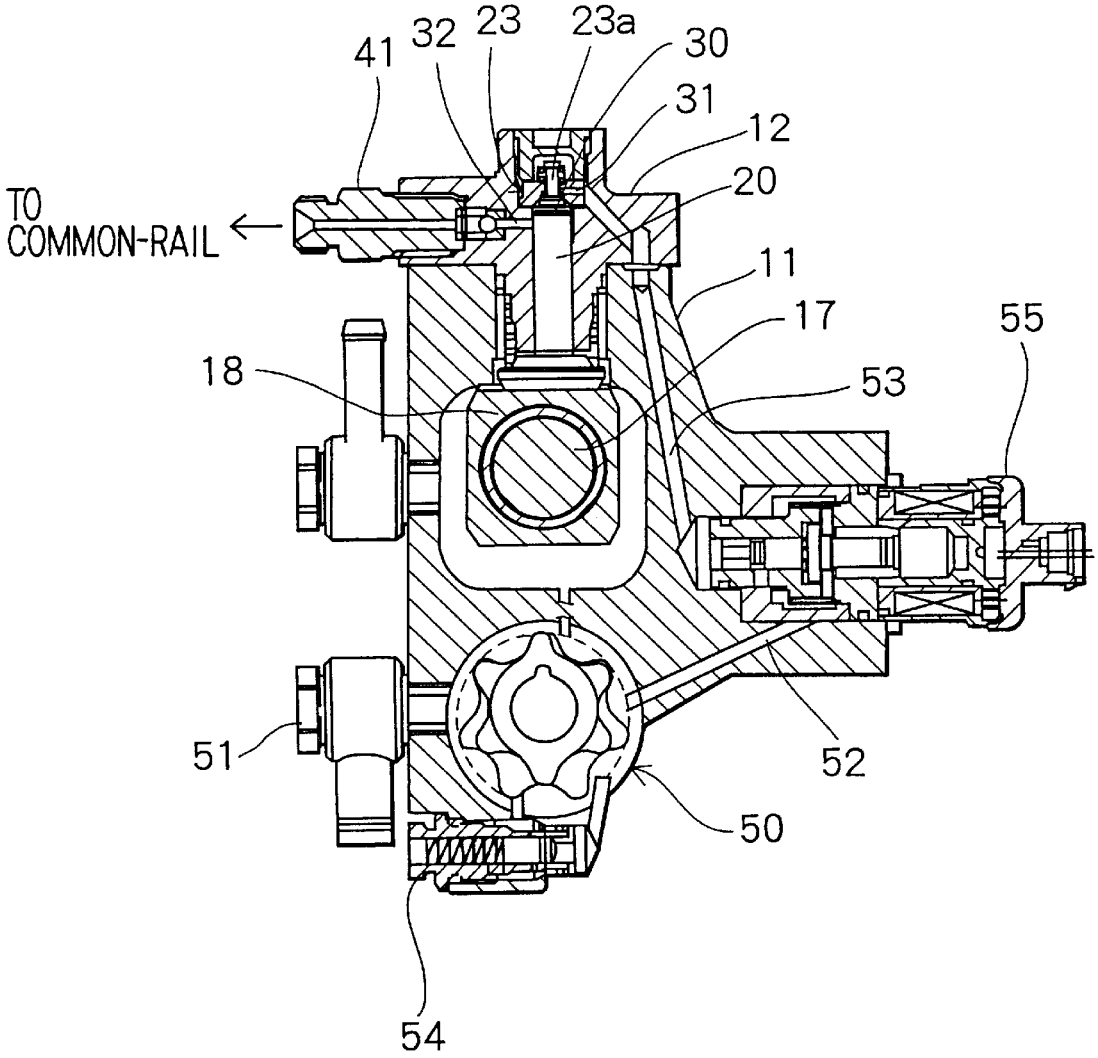
FIG. 7 is an explanatory illustration showing a fuel path according to the first embodiment.

Fuel inlet path and fuel outlet path of the fuel injection pump 10 are shown in FIG. 7. Location of components is different from the actual location. An inner gear-type feed pump 50 pressurizes the fuel sucked from a fuel tank not shown via a fuel inlet 51, and sends it to a fuel passage 52. When the fuel pressure in the feed pump 50 reaches a predetermined pressure, a regulate valve 54 opens and excessive fuel returns to the fuel tank.

A metering valve 55 for connecting and disconnecting the communication between the fuel passage 52 and the fuel passage 53 is an electromagnetic valve for metering fuel amount sucked into the fuel pressure chamber 30 from the fuel inlet passage 31 communicating with the fuel passage 53 via the check valve 23 according to the engine driving condition.

Operations of the fuel injection pump 10 will now be explained.

The cam 17 rotates as the drive shaft 14 rotates, and the shoe 18 revolves without rotation as the cam 17 rotates. The flat contact surfaces formed on the shoe 18 and the plunger 20 slide each other as the shoe 18 revolves, and the plunger 20 reciprocates.

When the plunger 20 at the top dead center is lowered according to the revolution of the shoe 18, the discharged fuel discharged from the feed pump 50 is controlled by the metering valve 55, and the metered fuel flows in the fuel pressure chamber 30 from the fuel inlet passage 31 via the check valve 23. When the plunger 20 at the bottom dead center rises toward the top dead center again, the check valve 23 is closed, and the fuel pressure in the fuel pressure chamber 30 increases. When fuel pressure in the fuel pressure chamber 30 exceeds the respective fuel pressures in the fuel passages 41*a* and 42*a*, the respective check valves 44 open alternately.

Fuel pressurized in the fuel pressure chamber 30 at the cylinder head 12 side is sent to the fuel passage 41*a* via the fuel discharge passage 32, the check valve 44 and the fuel chamber 33. Fuel pressurized in the fuel pressure chamber 30 at the cylinder head 13 side is sent to the fuel chamber 33 via the fuel discharge passage 32, check valve 44, fuel passage 42*a*, fuel line 49, fuel passage 40*a* formed in the connecting member 40, and the communication passage 35.

The fuel pressurized in both fuel pressure chambers 30 are merged at the fuel chamber 33 to be supplied to a common-rail not shown via the fuel passage 41*a*. Specifically, the fuel discharged from the fuel discharge passage 32 formed on the cylinder heads 12, 13 is not directly merged in the pump housing, but the fuel discharged outside the pump housing via the fuel line 49 from the fuel discharge passage 32 formed on the cylinder head 13 merges with the fuel discharged from the fuel discharge passage 32 formed on the cylinder head 12 at the fuel chamber 33 formed on the cylinder head 12.

The common-rail accumulates pressure of the fuel having pressure fluctuation supplied from the fuel injection pump 10, and maintains the pressure constant. High pressure fuel is supplied from the common-rail to an injector not shown. The pressure limiter 43 sets the fuel pressure to be supplied to the common-rail to a predetermined pressure or less. The pressure limiter 43 functions as a safety valve to prevent an undesirable condition of its entire system, such as a condition that all pressurized fuel is fed from the fuel injection pump 10 when, for example, the metering valve 55 fails and fully opens. As long as the metering valve 55 normally operates and the fuel sucked into the fuel pressure chamber 30 is controlled according to the engine driving condition, it is not necessary to install the pressure limiter 43 in the fuel injection pump 10.

The pressure limiter 43 may be installed in, for example, the common-rail instead of the fuel injection pump 10. Furthermore, a pressure control electromagnetic valve may be used instead of the pressure limiter 43. Common-rail pressure may be controlled under reduced pressure by the pressure control electromagnetic valve when, for example, the common-rail pressure is required to be reduced such as during the deceleration.

Figure 8:
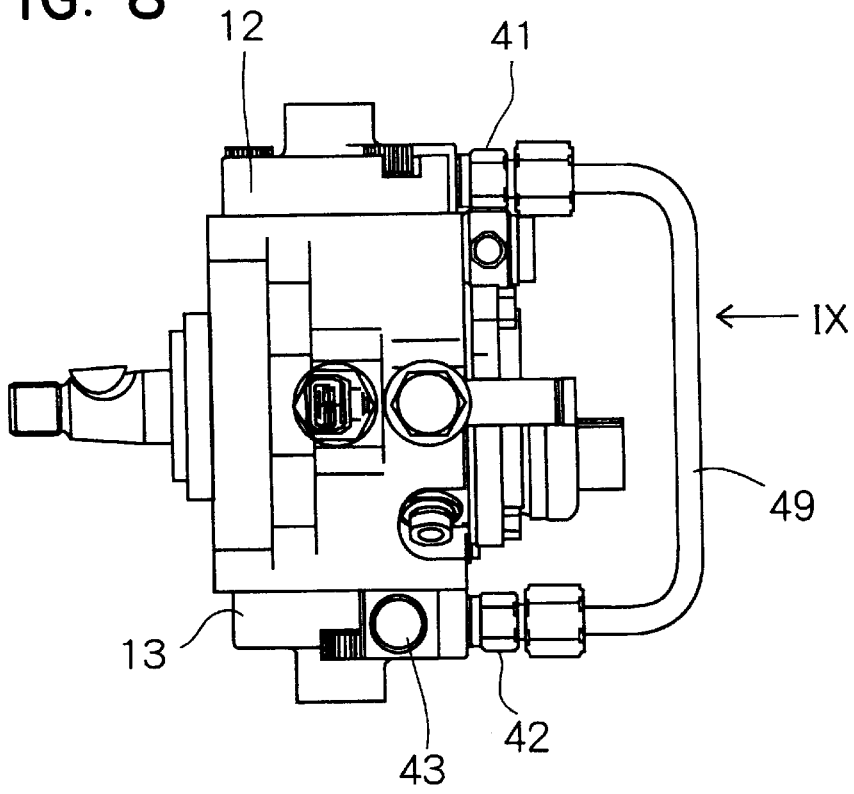
FIG. 8 is a front view, viewed from the same direction as FIG. 5, of a first modification of the first embodiment which has a different fuel line arrangement from the one of the first embodiment.

According to the first embodiment, the connecting members 40 and 42 are connected by the fuel line 49, and fuel in respective fuel pressure chambers 30 is merged in the fuel chamber 33 formed on the cylinder head 12 and is fed to the common-rail. However, the first embodiment may be modified as a first modification of the first embodiment shown in FIGS. 8 and 9. According to the first modification of the first embodiment, the connecting members 41 and 42 are connected by the fuel line 49, and fuel in respective fuel pressure chambers 30 is merged at the fuel chamber 33 formed on the cylinder head 12 to feed it to the common-rail via the connecting member 40.

Figure 10:
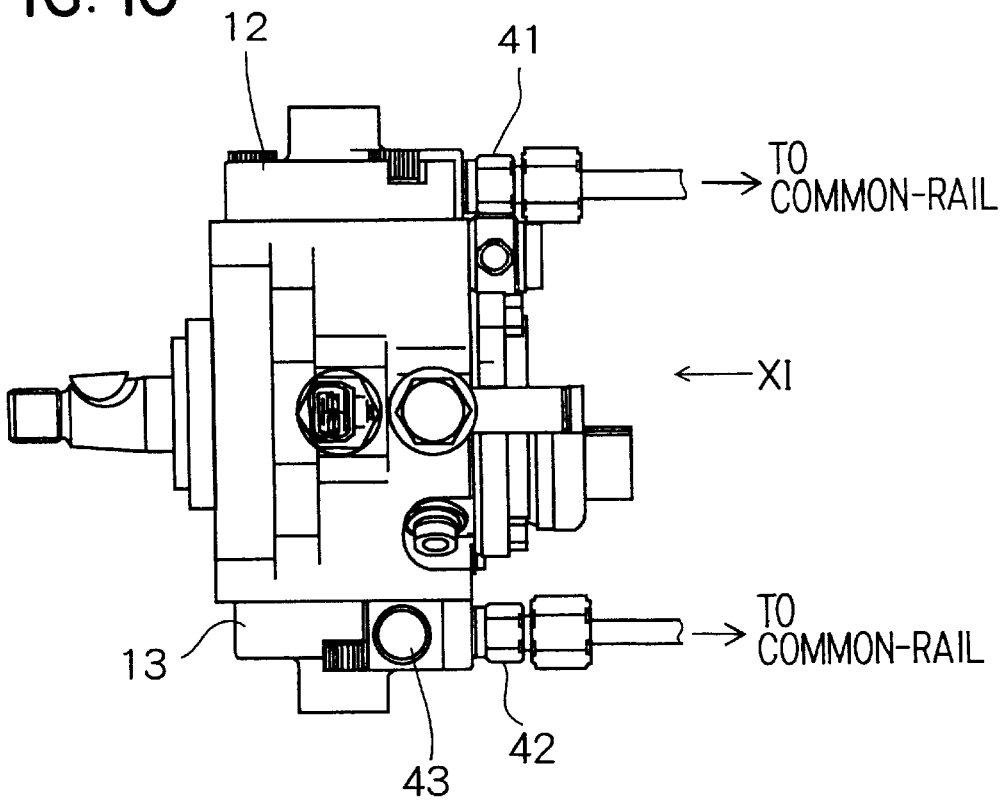
FIG. 10 is a front view, viewed from the same direction as FIG. 5, of a second modification of the first embodiment which has a different fuel line arrangement from the one of the first embodiment.
Figure 11:
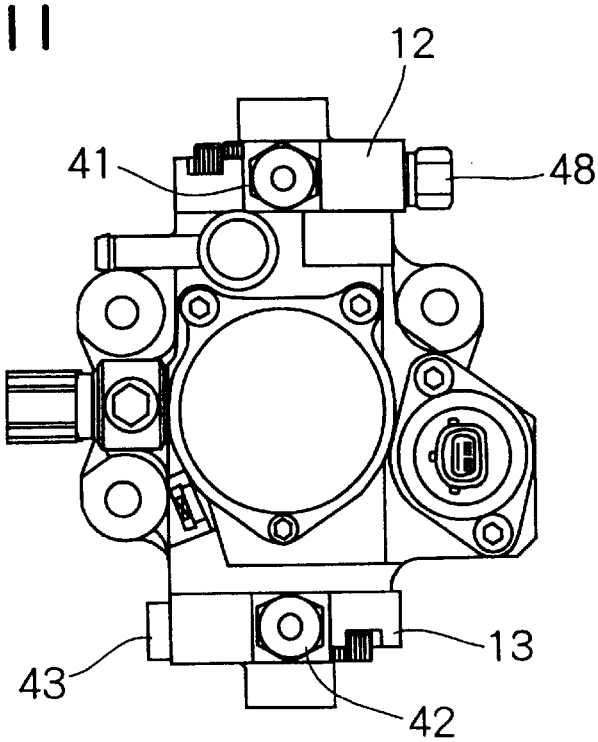
FIG. 11 is a front view viewed from the arrow XI in FIG. 10 according to the second modification of the first embodiment.

Further, the first embodiment may be modified as a second modification of the first embodiment shown in FIGS. 10 and 11. According to the second modification of the first embodiment, the connecting members 41 and 42 are connected to the common-rail by the fuel line 49, and fuel in respective fuel pressure chambers 30 is individually fed to the common-rail via respective cylinder heads 12 and 13. The communication passage 35 (not shown in FIGS. 10 and 11) of the cylinder head 12 is closed by a sealing plug 48.

Figure 9:
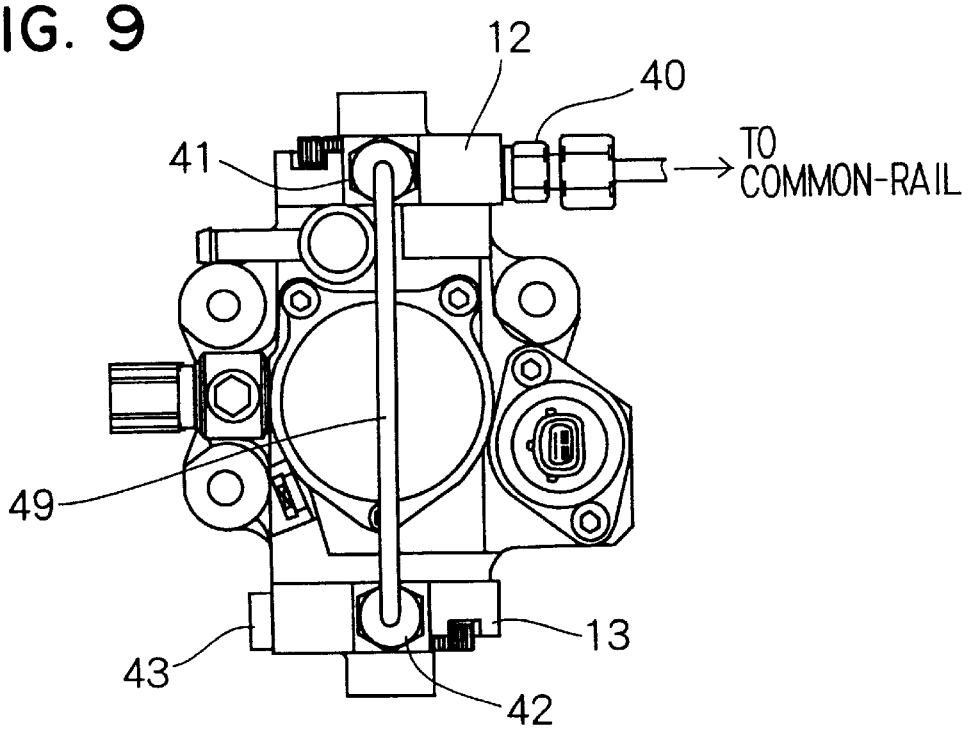
FIG. 9 is a front view viewed from the arrow IX in FIG. 8 according to the first modification of the first embodiment.
Figure 12:
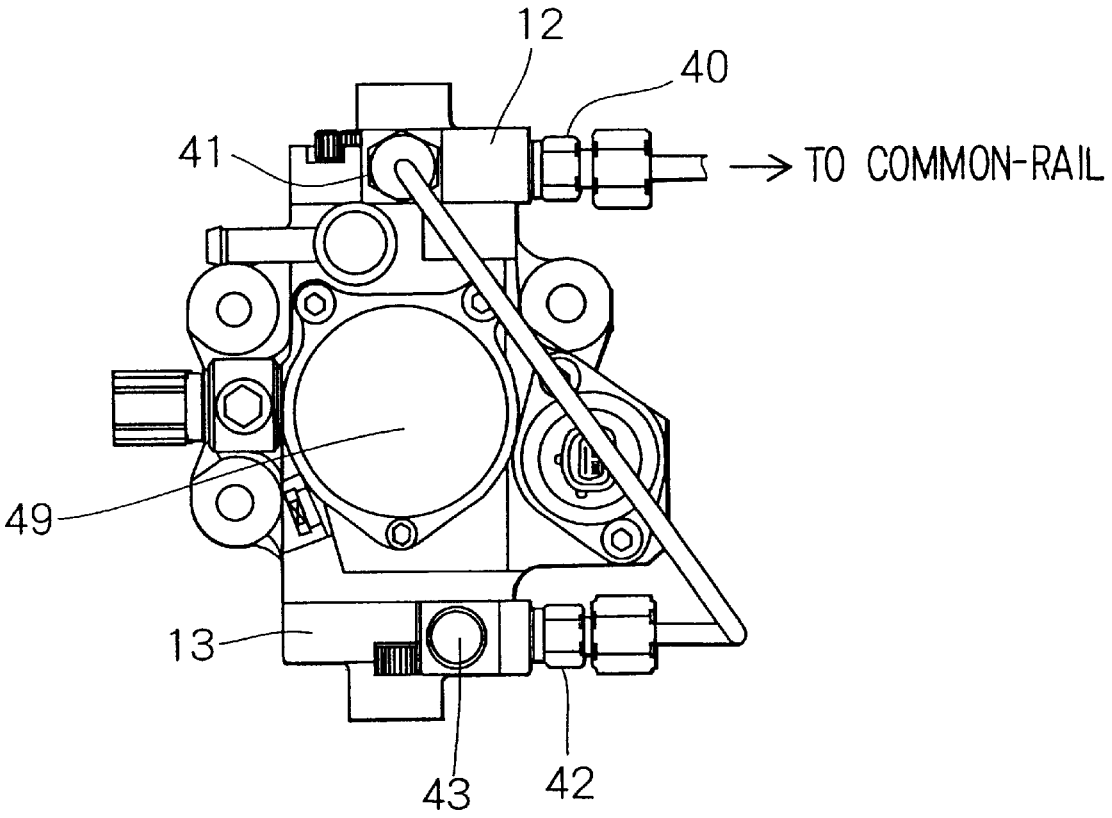
FIG. 12 is a front view, viewed from the same direction as FIG. 5, of a third modification of the first embodiment whose fuel outlets and fuel openings on a cylinder head are respectively arranged in the same direction.

According to a third modification of the first embodiment shown in FIG. 12, the cylinder heads 12 and 13 are assembled such that the respective fuel outlets 34*a* as well as the respective fuel openings 36*a* formed on the cylinder heads are disposed in the same direction. In other words, the cylinder head 13 in FIG. 9 is rotated 90° clockwise in FIG. 12.

(Second embodiment)

Figure 13:
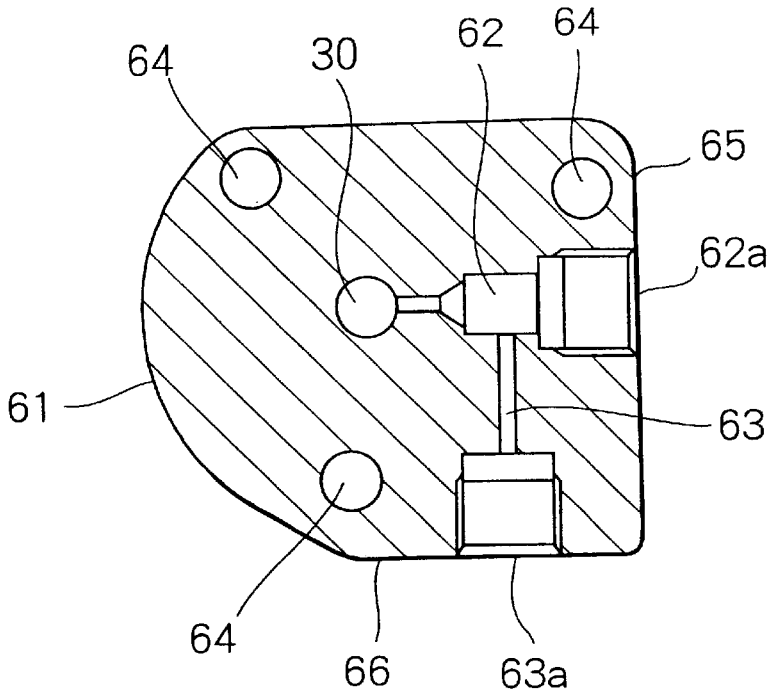
FIG. 13 is a sectional view showing a cylinder head according to a second embodiment of the present invention.
Figure 14:
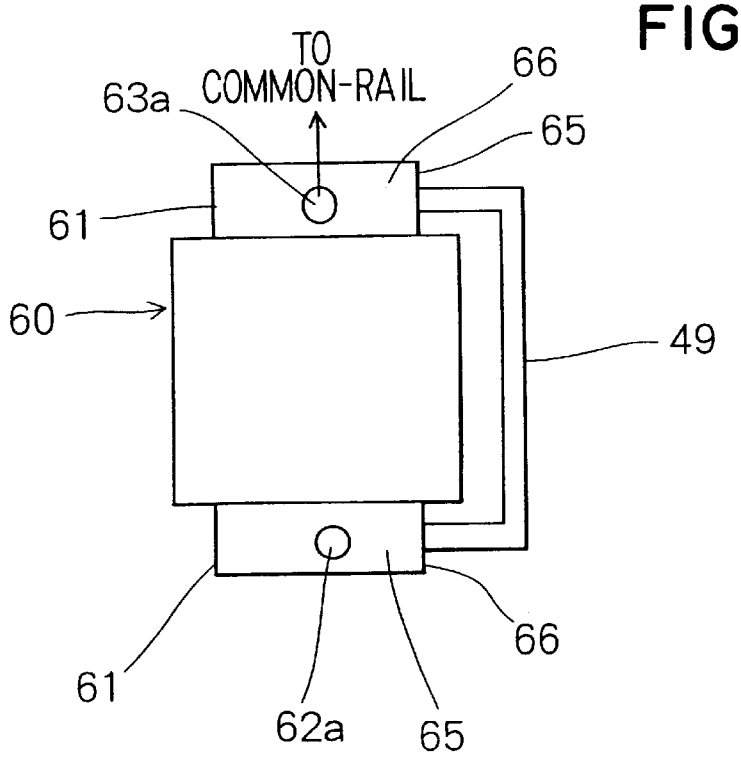
FIG. 14 is an explanatory illustration showing a connection of fuel lines according to the second embodiment.

A fuel injection pump according to a second embodiment of the present invention is shown in FIGS. 13 and 14. Components which are substantially the same as those in the first embodiment are assigned the same reference numerals.

In the first embodiment, the cylinder heads of the two cylinder fuel pump have different positions of tapped holes, fuel passages and the like. According to a fuel injection pump 60 in the second embodiment, however, cylinder heads 61 are identical and have the same positions of tapped holes, fuel passages and the like. As shown in FIG. 13, a fuel outlet 62*a* of a pressure feed fuel passage 62 and a fuel opening 63*a* of a fuel passage 63 have openings on respective outer peripheral walls 65 and 66 formed perpendicularly to the cylinder head 61.

As shown in FIG. 14 which schematically illustrates the structure of the fuel injection pump, the fuel outlet 62*a* formed on the first cylinder head 61 and the fuel opening 63*a* formed on the second cylinder head 61 are connected by the fuel line 49. Fuel is supplied to the common-rail via the first fuel opening 63*a*, and the pressure limiter is installed in the second fuel outlet 62*a*.

(Third embodiment)

Figure 15:
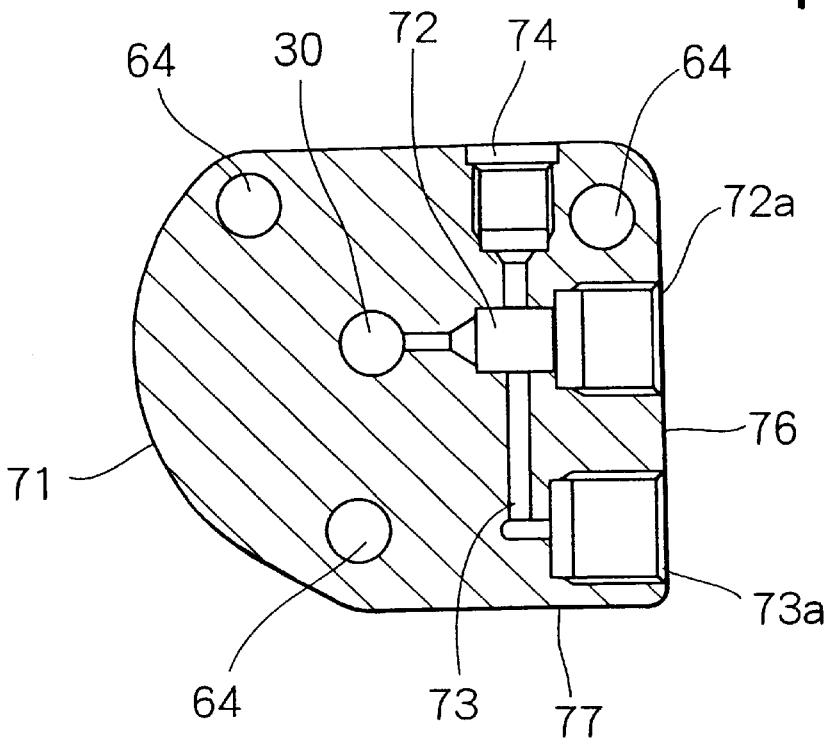
FIG. 15 is a sectional view showing a cylinder head according to a third embodiment of the present invention.
Figure 16:
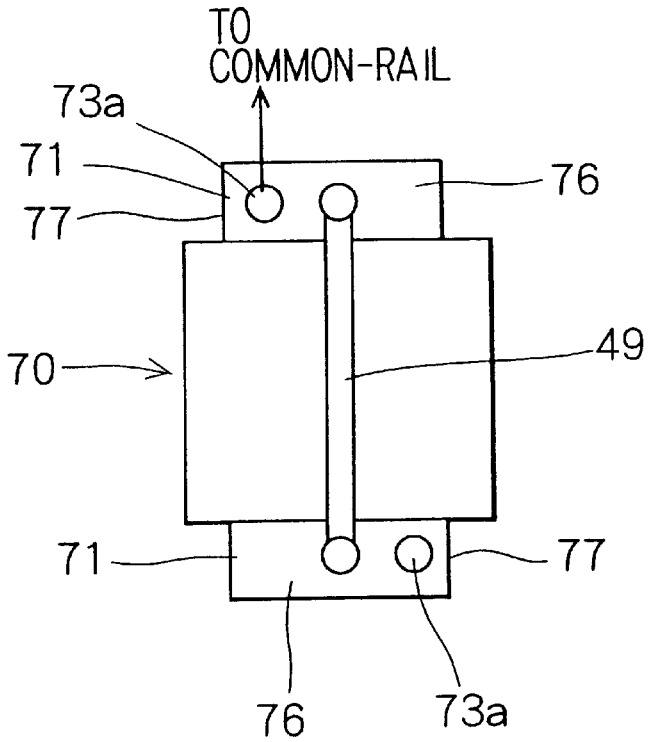
FIG. 16 is an explanatory illustration showing a connection of fuel lines according to the third embodiment of the present invention.

A fuel injection pump according to a third embodiment of the present invention is shown in FIGS. 15 and 16. Components which are substantially the same as those in the second embodiment are assigned the same reference numerals.

Although a cylinder head 71 used for a fuel injection pump 70 in the third embodiment has the same shape as the cylinder head 61 in the second embodiment, the positions of fuel passages are different from each other. As shown in FIG. 15, a fuel outlet 72*a* of a pressure feed fuel passage 72 and a fuel opening 73*a* of a fuel passage 73 have openings in the same direction on an outer peripheral wall 76. The outer peripheral wall 76 is formed perpendicular to an outer peripheral wall 77 on the cylinder head 71.

As shown in FIG. 16 which schematically illustrates the structure of the fuel injection pump, the fuel outlet 72*a* formed on the upper cylinder head 71 and the fuel outlet 72*a* formed on the lower cylinder head 71 are connected by the fuel line 49. Fuel is supplied to the common-rail via the upper fuel opening 73*a*, and the pressure limiter is installed in the lower fuel opening 73*a*.

(Fourth embodiment)

Figure 17:
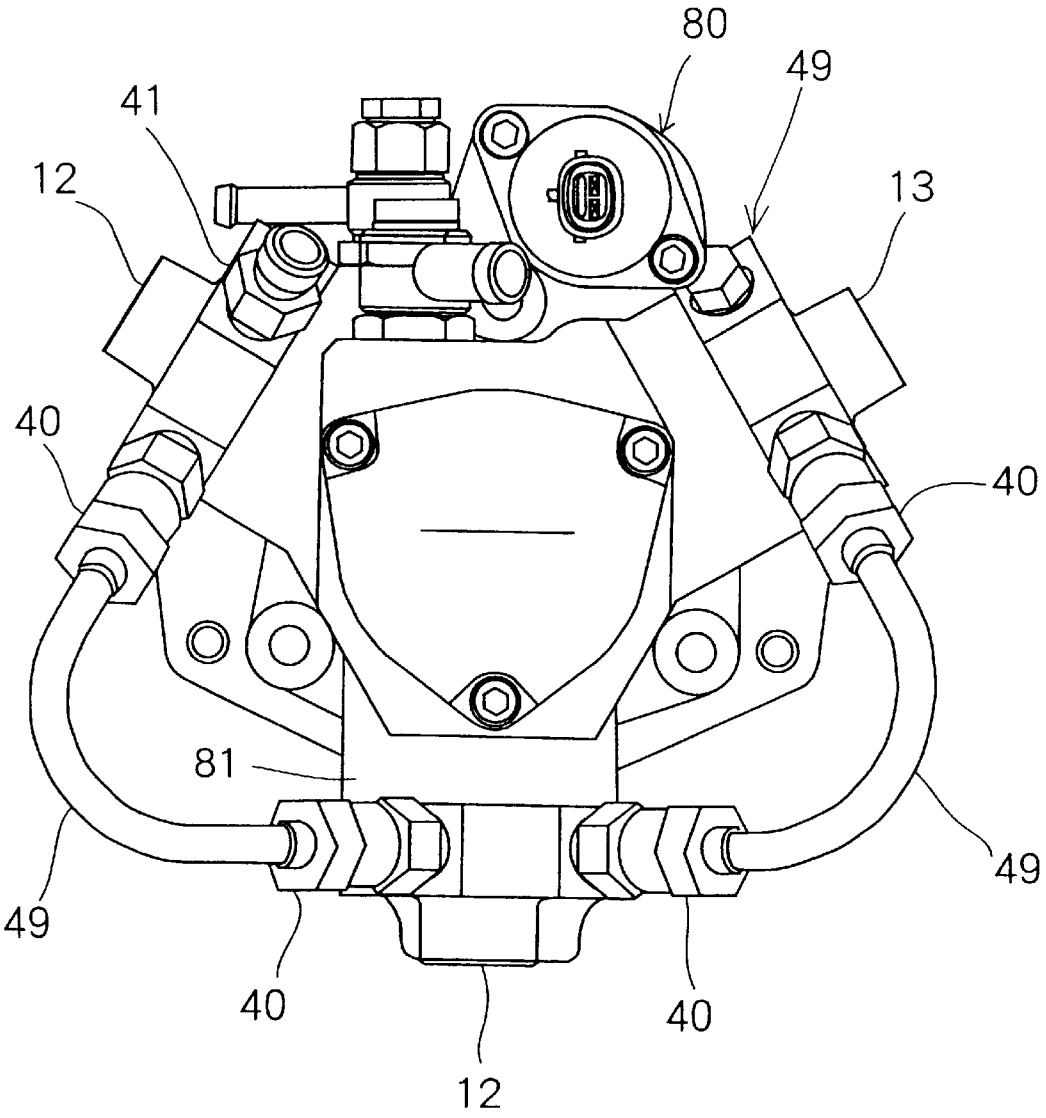
FIG. 17 is a front view of a fuel injection pump viewed from the same direction as FIG. 6 according to a fourth embodiment of the present invention.

A fuel injection pump according to a fourth embodiment of the present invention is shown in FIG. 17. Components which are substantially the same as those in the first embodiment are assigned the same reference numerals.

FIG. 17 shows a fuel injection pump 80 viewed from the same direction as FIG. 6. The fuel injection pump 80 has three cylinders, and two cylinder heads 12, one cylinder head 13 are radially provided on a main housing 81 having a gap of 120° between each cylinder head. The cylinder heads 12 and 13 for supporting the plunger such that the plunger reciprocates have the same shape as those in the first embodiment.

The connecting members 40 attached to the cylinder heads 12 and 13 are connected to each other by the fuel line 49. The fuel discharge passages for discharging fuel pressurized in respective fuel pressure chambers merge outside the cylinder head 12 to which the connecting member 41 is attached via the fuel line 49 without merging in the cylinder head, and fuel is supplied to the common-rail not shown from the connecting member 41.

(Fifth embodiment)

Figure 18:
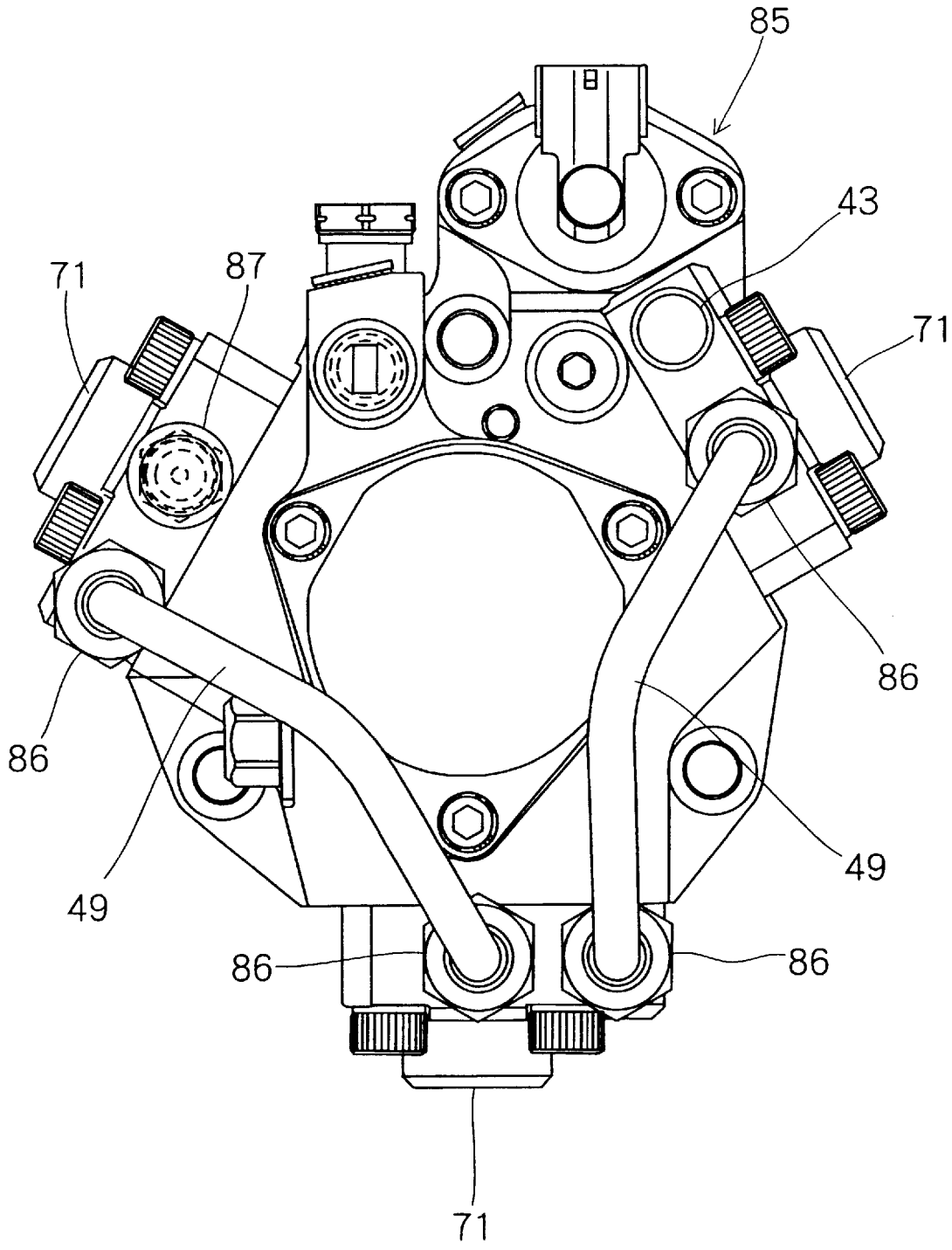
FIG. 18 is a front view of a fuel injection pump viewed from the same direction as FIG. 17 according to a fifth embodiment of the present invention having the same cylinder head as the one in the third embodiment.

A fuel injection pump according to a fifth embodiment of the present invention is shown in FIG. 18. Components which are substantially the same as those in the fourth embodiment are assigned the same reference numerals.

FIG. 18 shows a fuel injection pump 85 viewed from the same direction as FIG. 17. The fuel injection pump 85 has three cylinders, and the cylinder head 71 in the third embodiment is used as the cylinder head.

A connecting member 86 and the pressure limiter 43 are attached to one of three cylinder heads 71. Two connecting members 86 are attached to another cylinder head 71. The connecting member 86 and a connecting member 87 are attached to the other cylinder head 71. The fuel line 49, which is connected to the common-rail, is connected to the connecting member 87.

According to the above described embodiments of the present invention, the pressure feed fuel passages for feeding fuel pressurized in respective pressure chambers are formed in respective cylinder heads without directly communicating each other in the pump housing. Accordingly, compared to the structure that the respective pressure feed fuel passages are directly merged in the pump housing, the pressure feed fuel passage is shorter, and the members forming the pressure feed fuel passages are smaller. Thus, the fuel injection pump is reduced in size. Accordingly, the fuel injection pump is installed in a narrower space.

Furthermore, the fuel passage, having the opening on the outer peripheral wall of the cylinder head at a location different from the pressure feed fuel passage and communicating with the pressure feed fuel passage at the downstream side of the check valve provided at the downstream side of the fuel discharge passage, is formed. According to this structure, fuel discharged outside the pump housing from a cylinder head via the fuel line and fuel discharged from another cylinder head may be merged in the fuel chamber formed at the downstream side of the check valve provided on another cylinder head. Furthermore, the fuel may be individually supplied to the common-rail from respective cylinders. Since an interference between a component around the engine body and a fuel line is prevented by changing the combination of the fuel line connections, the installation degree of freedom for the fuel injection pump is improved. Further, the inner wall surface of the fuel line for connecting the fuel passages is smooth, and thereby bending the fuel line smoothly without creating a corner portion. Accordingly, the stress caused by fuel pressure is not concentrated on one portion of the fuel line.

Furthermore, the pressure feed fuel passage which is a high pressure fuel passage and the fuel passage are not formed in other than the cylinder head. Accordingly, the main housing which does not have the high pressure fuel passage may be made of a light material, such as aluminum. Therefore, the fuel injection pump is reduced in weight. Furthermore, since the high pressure fuel passage is not formed on plural parts of the pump housing, the seal between the pump housing parts is not necessary.

Further, since the pressure feed fuel passage is shorter and the fuel discharged from the cylinder head is merged at the downstream side of the check valve installed in the pressure feed fuel pump, machining the corner portion at the merging portion is facilitated, and the number of the manufacturing processes is reduced. Furthermore, since the pressure feed fuel passage and the fuel passage are formed in a straight shape, the passage length is shorter. Accordingly, machining the inner peripheral wall of the cylinder head forming respective passages is facilitated.

Further, since the cylinder heads are formed identical or in a substantially identical shape to modularize, the number of components is reduced and the installation of the cylinder heads is facilitated. Accordingly, the manufacturing cost is reduced.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection pump comprising:

a rotatable cam;

a drive shaft for transmitting a rotational force to said rotatable cam;

at least two fuel pressure chambers for pressurizing fuel;

at least two pressure feed fuel passages for transmitting fuel pressurized in said respective fuel pressure chambers;

a moving member for reciprocating according to a rotation of said cam to pressurize fuel in said fuel pressure chambers and to transmit said pressurized fuel to said pressure feed fuel passages;

at least two cylinder heads, each made of metal, and forming said respective fuel pressure chambers thereinside;

a main housing made of metal having a lesser hardness and weight than the metal of each of said cylinder heads for rotatably supporting said drive shaft, wherein;

each one of said pressure feed fuel passages includes a communication port for communicating with said fuel pressure chamber;

each one of said pressure feed fuel passages includes a fuel outlet; and said pressure feed fuel passages are formed in said cylinder heads, respectively.

2. A fuel injection pump as in claim 1, wherein each one of said pressure feed fuel passages is formed straightly.

3. A fuel injection pump as in claim 1, wherein;

the fuel injection pump includes at least two said moving members;

said at least two cylinder heads are individually formed for said respective moving members, and said main housing supports said respective cylinder heads such that said moving members reciprocate; and said cylinder heads are modularized in a substantially identical shape.

4. A fuel injection pump as in claim 1, wherein;

each said pressure feed fuel passage includes a check valve for allowing a fuel flow from said communication port toward said fuel outlet and for inhibiting a reversed fuel flow from said fuel outlet toward said communication port;

each said cylinder head includes a fuel passage having a fuel opening provided at an outer peripheral wall of said cylinder head at a position different from said fuel outlet; and said fuel passage communicates with said pressure feed fuel passage at a downstream side of said check valve.

5. A fuel injection pump as in claim 4, wherein an opening direction of said fuel outlet and an opening direction of said fuel opening are perpendicular to each other.

6. A fuel injection pump as in claim 4, wherein an opening direction of said fuel outlet and an opening direction of said fuel opening are parallel to each other.

7. A fuel injection pump as in claim 4, wherein;

one of said fuel outlet and said fuel opening of one of said cylinder heads is connected to one of said fuel outlet and said fuel opening of another cylinder head by a fuel line; and one of said fuel outlet and said fuel opening not connected to said fuel line is connected to a pressure accumulator for storing high pressure fuel, and the other is closed.

8. A fuel injection pump as in claim 7, wherein a pressure limiter is installed in said closed one of said fuel outlet and said fuel opening not connected to said fuel line.

9. A fuel injection pump as in claims 4, wherein;

one of said fuel outlet and said fuel opening of one of said cylinder heads and one of said fuel outlet and said fuel opening of another cylinder head are respectively connected to a pressure accumulator for storing high pressure fuel via a fuel line; and another one of said fuel outlet and said fuel opening of said one of said cylinder heads and another one of said fuel outlet and said fuel opening of said another cylinder head, which are not connected to said fuel line, are closed.

10. A fuel injection pump as in claim 9, wherein a pressure limiter is installed in one of said closed fuel outlet and said closed fuel opening.

11. A fuel injection pump as in claim 4, further comprising at least two fuel inlet passages for introducing fuel into said respective fuel pressure chambers and wherein each one of said fuel inlet passages includes a second check valve for allowing a fuel flow into said fuel pressure chamber and for inhibiting a fuel flow from said fuel pressure chamber.

12. A fuel injection pump according to claim 1, wherein said cylinder heads are each made of iron, and said housing is made of aluminum.

13. A fuel injection pump according to claim 1, wherein said housing supports said drive shaft at both sides of said cam.

14. A fuel injection pump comprising:

a rotatable cam;

a drive shaft for transmitting a rotational force to said cam;

at least two fuel pressure chambers for pressurizing fuel;

at least two fuel inlet passages for transmitting fuel pressurized in said respective fuel pressure chambers;

a moving member for reciprocating according to a rotation of said cam to pressurize fuel in said fuel pressure chambers and to transmit said pressurized fuel to said pressure feed fuel passages;

at least two cylinder heads forming said respective fuel pressure chambers thereinside; and a main housing for rotatably supporting said drive shaft, wherein;

each of said pressure feed fuel passages includes a communication port for communicating with said fuel pressure chamber;

each of said pressure feed fuel passages includes a fuel outlet;

each of said pressure feed fuel passages includes a first check valve for allowing fuel flow from said communication port toward said fuel outlet and for inhibiting a reversed fuel flow from said fuel outlet toward said communication port;

each of said fuel inlet passages includes a second check valve for allowing a fuel flow into said fuel pressure chamber and for inhibiting a fuel flow from said fuel pressure chamber, and said pressure feed fuel passages are formed in said cylinder heads, respectively.

15. A fuel injection pump comprising:

a rotatable cam;

a drive shaft for transmitting a rotational force to said rotatable cam;

at least two fuel pressure chambers for pressurizing fuel;

at least two pressure feed fuel passages for transmitting fuel pressurized in said respective fuel pressure chambers;

at least two moving members for reciprocating according to a rotation of said cam to pressurize fuel in said fuel pressure chambers and to transmit said pressurized fuel to said pressure feed fuel passages;

at least two individually formed cylinder heads made of metal, and forming said respective fuel pressure chambers thereinside, said cylinder heads slidably receiving said moving members; and a main housing for supporting said respective cylinder heads such that said moving members reciprocate, and for rotatably supporting said drive shaft, wherein;

each of said pressure feed fuel passages includes a communication port for communicating with a respective said fuel pressure chamber;

each of said pressure feed fuel passages includes a fuel outlet; and said pressure feed fuel passages are formed in said cylinder heads, respectively.

16. A fuel injection pump as in claim 15, wherein said cylinder heads are modularized in a substantially identical shape.

17. A fuel injection pump according to claim 15, wherein said cylinder heads are each made of iron, and said housing is made of aluminum.

18. A fuel injection pump according to claim 15, wherein said housing supports said drive shaft at both sides of said cam.

* * * * *